US010119797B2

(12) United States Patent
Burczynski

(10) Patent No.: US 10,119,797 B2
(45) Date of Patent: Nov. 6, 2018

(54) CAP-BASED HEAT-MITIGATING NOSE INSERT FOR A PROJECTILE AND A PROJECTILE CONTAINING THE SAME

(71) Applicant: Sig Sauer, Inc., Newington, NH (US)

(72) Inventor: Thomas J. Burczynski, Montour Falls, NY (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 15/906,440

(22) Filed: Feb. 27, 2018

(65) Prior Publication Data

US 2018/0245896 A1 Aug. 30, 2018

Related U.S. Application Data

(60) Provisional application No. 62/463,773, filed on Feb. 27, 2017.

(51) Int. Cl.

| | |
|---|---|
| ***F42B 10/00*** | (2006.01) |
| ***F42B 10/38*** | (2006.01) |
| ***F42B 12/34*** | (2006.01) |
| ***F42B 12/78*** | (2006.01) |

(52) U.S. Cl.
CPC ..... *F42B 10/38* (2013.01); *F42B 12/34* (2013.01); *F42B 12/78* (2013.01)

(58) Field of Classification Search
CPC ..... F42B 10/38; F42B 10/42; F42B 10/46; F42B 12/34; F42B 12/72; F42B 12/74; F42B 12/745; F42B 12/78
See application file for complete search history.

(56) References Cited

U.S. PATENT DOCUMENTS 1,107,722 A * 8/1914 Starkweather ..... F42B 12/34 102/507
3,971,024 A * 7/1976 Clark, Jr. ..... H01Q 1/281 102/211

(Continued)

FOREIGN PATENT DOCUMENTS

DE 9219134 U1 * 4/1998 ..... F24B 12/74
DE 19930473 A1 * 1/2001 ..... F24B 12/34
DE 19930474 A1 * 1/2001 ..... F42B 12/34

OTHER PUBLICATIONS

Emary, Dave, "A Technical Discussion of the ELD-X™ (Extremely Low Drag—eXpanding) & ELD™ Match (Extremely Low Drag Match) Bullets with Heat Shield™ Tip," dated Oct. 2015, 23 pages.

*Primary Examiner* — Gabriel J. Klein
(74) *Attorney, Agent, or Firm* — Finch & Maloney PLLC

(57) ABSTRACT

Techniques and architecture are disclosed for a nose insert for use in a projectile. The nose insert includes a polymer nose element and a metal cap. The polymer nose element includes a rear shank portion and a tapered head portion. Disposed onto the tapered head portion of the polymer nose is the metal cap. The metal includes an outer curved portion that terminates at a forward end in a meplat. In some embodiments, the metal cap prevents deformation of the polymer nose element caused by high stagnation temperatures experienced by the projectile during flight. In some other embodiments, the metal cap includes a locking ridge. The locking ridge is disposed on an inner surface of the metal cap component and interfaces with an outer surface of the tapered head portion of the polymer nose element.

20 Claims, 8 Drawing Sheets

(56) References Cited

U.S. PATENT DOCUMENTS

| | | | | | |
|---|---|---|---|---|---|
| 4,776,279 | A * | 10/1988 | Pejsa | F42B 12/34 | 102/510 |
| 5,621,186 | A * | 4/1997 | Carter | F42B 12/34 | 102/507 |
| 7,299,750 | B2 * | 11/2007 | Schikora | F42B 12/34 | 102/506 |
| 2006/0124022 | A1 * | 6/2006 | Eberhart | F42B 12/34 | 102/508 |
| 2012/0111220 | A1 * | 5/2012 | King | F42B 12/34 | 102/509 |
| 2016/0169645 | A1 | 6/2016 | Emary et al. | | |
| 2018/0094911 | A1 * | 4/2018 | Fournier | F42B 12/34 | |

* cited by examiner

CAP-BASED HEAT-MITIGATING NOSE INSERT FOR A PROJECTILE AND A PROJECTILE CONTAINING THE SAME

CROSS-REFERENCE TO RELATED APPLICATIONS

This application claims the benefit of U.S. Provisional Patent Application No. 62/463,773, filed on Feb. 27, 2017, which is herein incorporated by reference in its entirety.

FIELD OF THE DISCLOSURE

This disclosure relates to firearm ammunition, and more particularly to a heat-resistant nose insert for a projectile.

BACKGROUND

Firearms, such as rifles, are used in target or match shooting competitions and for hunting sporting game. A firearm is configured to launch a bullet towards a target located within an area. The bullet is designed to travel through the air and impact the target located at a distance away from a shooter's position within the area. Before firing, the bullet is disposed within a cartridge that includes a propellant and a primer. Upon activating a trigger assembly of the firearm, a firing pin within the firearm engages the primer to discharge the propellant to launch the bullet through the barrel of the firearm and towards the intended target.

SUMMARY

One example embodiment of the present disclosure provides a nose insert for use in a projectile, the nose insert including a polymer nose element including a rear shank portion and a tapered head portion; and a metal cap disposed on the tapered head portion of the polymer nose element, the metal cap including an outer curved portion that terminates at a forward end in a meplat. In some cases, the metal cap comprises one of aluminum, aluminum alloy, copper, copper alloy, bronze, brass, mild steel, stainless steel and metal or metal alloy having a melting temperature of at least 1200 degrees F. In some cases, the polymer nose element is a crystalline polymer. In yet other cases, the polymer nose element is an amorphous polymer. In other cases, the metal cap prevents deformation of the polymer nose element caused by high stagnation temperatures experienced by the projectile during flight. In some other cases, the tapered head portion of the polymer nose element includes a first curved portion and a second curved portion, the first curved portion extending from a forward end of the tapered head portion to the second curved portion, and a shoulder defines a sloping angle between the first curved portion and the second curved portion. In some such cases, the second curved portion of the tapered head portion and the metal cap includes a tapered outer curvature, wherein both the second curved portion and the tapered outer curvature include a common radius. In other cases, the metal cap is ogival in shape and terminates in a flat meplat at a forward end. In some other cases, the metal cap is ogival in shape and terminates in a spherical meplat at a forward end. In yet other cases, the metal cap includes a wall thickness ranging from 0.005 of an inch to 0.020 of an inch. In some other cases, the tapered head portion includes a first curved portion that contacts an inner surface of the metal cap when the metal cap is disposed on the polymer nose element. In other cases, the metal cap covers a first curved portion of the tapered head portion, such that at least a portion of an inner surface of the metal cap contacts the first curved portion. In some other cases, a space exists between an inner wall of the metal cap and a forward end of the tapered head portion of the polymer nose element. In yet other cases, the metal cap includes a locking ridge, the locking ridge is disposed on an inner surface of the metal cap and interfaces with an outer surface of the tapered head portion of the polymer nose element. In other cases, the rear shank portion of the polymer nose element is adjacent to a shoulder of a curved portion of the tapered head portion. In some cases, the rear shank portion comprises a first section including a first diameter, a second section including a tapered surface, and a third section including a second diameter smaller than the first diameter, wherein the first section includes a first end and a second end, the first end is attached to a shoulder of the tapered head portion of the polymer nose element, and the second end of the first section is attached to the second section and the second section attached to the third section, and the first section, second section and third sections are attached to one another along an axis of the nose insert. In some other cases, the meplat of the metal cap is flat and has a diameter between 0.001 and 0.100 of an inch. In yet other cases, the meplat of the metal cap defines a radius having a width between 0.001 and 0.100 of an inch. In other cases, the tapered head portion of the polymer nose element includes a diameter equal to an outer diameter the metal cap. In some cases, the tapered head portion of the polymer nose element and an outer surface of the metal cap have a common ogive radius. In other cases, the metal cap is one of anodized, dyed and colored. In yet other cases, the metal cap can operate in temperatures between 1,200 degrees F. and 2,700 degrees F. without deforming. In some other cases, the polymer nose element expands upon impact with a target.

Another example embodiment of the present disclosure provides a projectile including a unitary body, including a forward end opposite a rear end and an intermediate cylindrical portion positioned between the rear end and the forward end, the unitary body further including a cavity within the forward end and a nose insert positioned in the cavity, the nose insert includes a polymer nose element including a rear shank portion and a tapered head portion, and a metal cap disposed on the tapered head portion of the polymer nose element, the metal cap including an outer curved portion that terminates at a forward end in a meplat. In some instances, the projectile includes a rear end, the rear end including a boat tail configuration. In yet other instances, the projectile includes a rear end, the rear end including a flat base configuration.

Another example embodiment of the present disclosure provides a projectile including the nose insert, the nose insert includes a polymer nose element including a rear shank portion and a tapered head portion, and a metal cap disposed on the tapered head portion of the polymer nose element, the metal cap including an outer curved portion that terminates at a forward end in a meplat, and wherein the tapered head portion of the polymer nose element, an outer surface of the metal cap, and an outer surface of a jacket include a common ogive radius. In some cases, the common ogive radius is a tangent ogive. In other cases, the common ogive radius is a secant ogive.

Another example embodiment of the present disclosure provides a nose insert for use in a projectile, the nose insert including a polymer nose element including a tapered head portion attached to a shank portion, the tapered head portion including a forward tapered portion and a rear tapered portion, the rear tapered portion being between the forward tapered portion and the shank portion, and the shank portion including a diameter smaller than a diameter of the rear tapered portion adjacent to the shank portion; and a metal cap disposed on the forward tapered portion of the tapered head portion of the polymer nose element, the metal cap terminates at a forward end in a meplat. In some instances, the metal cap prevents deformation of the polymer nose element during flight of the projectile at temperatures of between 1,200 degrees F. and 2,700 degrees F. In some instances, the metal cap includes a wall thickness ranging from 0.005 of an inch to 0.020 of an inch. In yet some instances, the metal cap includes a wall thickness that varies along a length of the metal cap so that a forward portion of the metal cap has increased wall thickness than a rear portion of the metal cap. In some instances, a first curved portion of the tapered head portion of the polymer nose element is in contact with an inner surface of the metal cap when the metal cap is disposed on the polymer nose element. In some instances, the metal cap includes a locking ridge, the locking ridge is disposed on an inner surface of the metal cap and interfaces with an outer surface of the tapered head portion of the polymer nose element. In some such instances, the locking ridge is disposed along a circumference of an interior wall of the metal cap and extends from the interior wall inwardly towards a central axis of the nose insert. In some instances, the meplat of the metal cap is flat and has a diameter between 0.001 and 0.100 of an inch. In some other instances, the meplat of the metal cap defines a radius having a width between 0.001 and 0.100 of an inch. In some instances, the tapered head portion of the polymer nose element and an outer surface of the metal cap have a common ogive radius. In other instances, the tapered head portion of the polymer nose element includes a first curved portion, a second curved portion, and a shoulder, the first curved portion extending from a forward end of the tapered head portion to the second curved portion, and the shoulder defines a sloping angle between the first curved portion and the second curved portion. In some such instances, the sloping angle between the first curved portion and the second curved portion is less than 90 degrees from a central axis of the nose insert. In other such instances, an outer surface of the first curved portion of the tapered head portion of the polymer nose element is recessed below an outer surface of the second curved portion of the tapered head portion of the polymer nose element, such that an outer surface of the metal cap and the second curved portion have a common ogive radius. In yet some other such instances, the second curved portion of the tapered head portion of the polymer nose element and a tapered outer curvature of the metal cap include a common radius.

Another example embodiment of the present disclosure provides a projectile including a unitary body, including a forward end opposite a rear end and an intermediate cylindrical portion positioned between the rear end and the forward end, the unitary body further including a cavity within the forward end; a nose insert disposed in the unitary body, the nose insert comprising a polymer nose element received within the cavity of the unitary body and including a tapered head portion attached to a shank portion, the tapered head portion including a forward tapered portion and a rear tapered portion, the rear tapered portion being between the forward tapered portion and the shank portion, and the shank portion including a diameter smaller than a diameter of the rear tapered portion adjacent to the shank portion; and a metal cap disposed on the forward tapered portion of the tapered head portion of the polymer nose element, the metal cap terminates at a forward end in a meplat. In some cases, the projectile further includes an ogive radius for each of an outer surface profile of the tapered head portion of the polymer nose element and an outer surface profile of a jacket of the projectile, wherein the ogive radius is the same for each of the outer surface profile of the tapered head portion of the polymer nose element and the outer surface profile of a jacket of the projectile. In some other cases, the projectile further includes an ogive radius for each of an outer surface profile of the tapered head portion of the polymer nose element and an outer surface profile of the outer curved portion of the metal cap, wherein the ogive radius is the same for each of the outer surface profile of the tapered head portion of the polymer nose element and the outer surface profile of the outer curved portion of the metal cap. In yet other cases, the projectile further includes an ogive radius for each of an outer surface profile of the tapered head portion of the polymer nose element, an outer surface profile of the outer curved portion of the metal cap, and an outer surface profile of a jacket of the projectile, wherein the ogive radius is the same for each of the outer surface profile of the tapered head portion of the polymer nose element, the outer surface profile of the outer curved portion of the metal cap, and the outer surface profile of a jacket of the projectile. In some cases, the nose insert is disposed within the unitary body, such that a rear surface of the shank portion of the polymer nose element is not in contact with a bottom surface of the cavity of the unitary body. In some such cases, in response to impact of the projectile with a target, the nose insert is configured to move rearward within the cavity of the unitary body to expand the projectile.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

Figure 1:
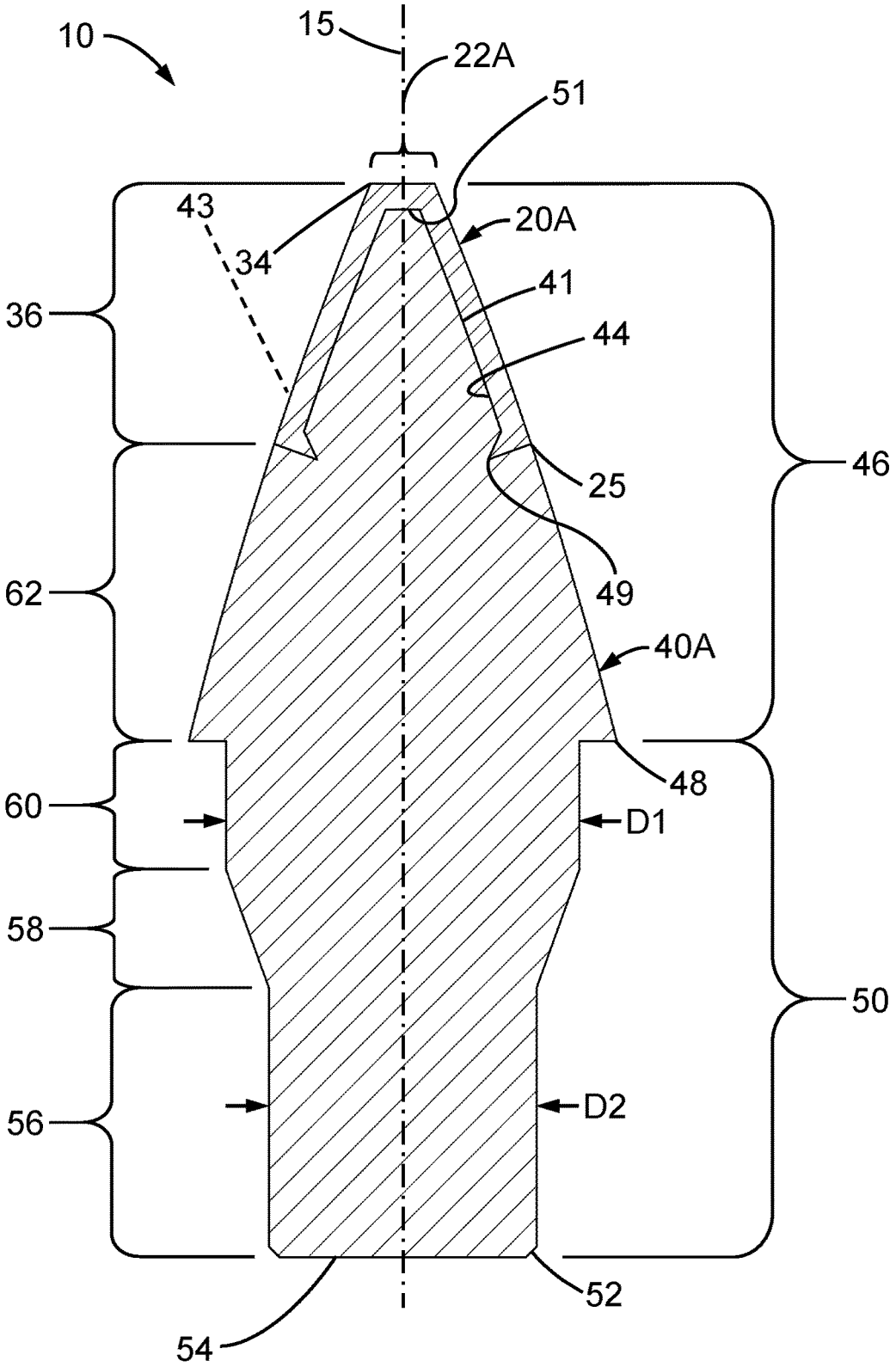
FIG. 1 is a longitudinal cross-sectional view of a nose insert for a projectile including a polymer nose element and a metal cap, in accordance with an embodiment of the present disclosure.

These and other features of the present embodiments will be understood better by reading the following detailed description, taken together with the figures herein described. The accompanying drawings are not intended to be drawn to scale. For purposes of clarity, not every component may be labeled in every drawing.

DETAILED DESCRIPTION

The disclosure is generally directed to a two-component hybrid nose insert for use in a projectile that can prevent tip deformation (e.g., melting) during projectile flight, as well as a projectile containing the nose insert. The nose insert includes a resilient polymer nose element partially covered with a tapered metal cap that is non-deformable in flight. The tapered metal cap also serves to shield the underlying polymer material, thereby protecting it and ultimately preventing the nose element from melting or otherwise deforming in flight. In the case of a hunting projectile, the tapered metal cap and resilient polymer element coalesce or are otherwise combined together to provide both high retained velocity during projectile flight and the ability to expand or mushroom on impact with a target, and in particular fluid based targets at long range.

General Overview

The requirements for a long-range projectile vary and are dependent upon the particular activity in which the shooter engages. Long-range target shooting or match shooting, for example, requires a very accurate, extremely well-balanced projectile having a high ballistic coefficient. The "Ballistic Coefficient" (BC) is an index of the manner in which a particular projectile decelerates in free flight expressed mathematically in equation (1), shown below.

$$C = \frac{W}{id^2} \qquad \text{Equation (1)}$$

Where:

C—Ballistic Coefficient

W—Mass, in pounds i—Coefficient of Form (i.e., form factor)

d—Bullet Diameter, in inches

The BC represents the ability of a bullet to overcome the air resistance in flight. Generally speaking, most long-range projectiles used for target shooting provide poor terminal performance if used for hunting game animals. Terminal performance is a measure of a projectile's behavior upon impact with a given target, for example an amount the projectile expands (e.g., mushrooms) or the depth a projectile penetrates the target at extended range. On the other hand, a hunting projectile can be less accurate than target projectiles but possess a reasonably high BC while providing exceptional terminal performance (e.g., the projectile's ability to expand or mushroom on impact and penetrate to a desired depth within a target at extended range). Over the years, many attempts have been made to design projectiles that meet both requirements of long-range accuracy and terminal performance. These efforts have been met with varying degrees of success.

Boat tail hollow point (BTHP) projectiles provide, for example, accuracy, good aerodynamics and a reduction in time of flight from the firearm muzzle to a target. Reduced flight time is important with respect to long-range targets because atmospheric conditions have less time to adversely affect the flight of the projectile, and thus degrade its accuracy. BTHP projectiles can be used for both match shooting and hunting but the downside in either case is a lower than ideal BC results due to the relatively large size of the projectile's "meplat" (defined here for convenience as "the blunt tip of a projectile, specifically the tip's diameter"). Several factors determine a projectile's BC but the width and resultant square area of a projectile's meplat is a key factor that can significantly raise or lower its BC depending on its size. While a boat tailed Open Tip Match (OTM) projectile has a velocity conserving advantage over a BTHP hunting projectile in that its meplat is smaller (due to a very small cavity centered within the meplat), its relatively large width still limits its BC. In order for a hunting projectile having a hollow point cavity to reliably expand upon impact with a fluid based target at long range, the diameter of the hollow point cavity within its meplat must be sufficiently large. Thus, the hunting projectile has a wider meplat than that of, an OTM projectile.

Alternatives to BTHP projectiles include large, pointed metal tips machined from bronze, brass or aluminum, that are used as nose inserts. Various problems exist with such designs. For example, at long ranges (e.g., greater than 200 yards), these projectiles often do not expand sufficiently, if at all, upon impact with the fluid based target, and thus provide poor terminal performance. In addition, after assembly of the projectile any appreciable eccentricity or skew that exists at the inserted tip along an axis of the projectile can degrade accuracy of the projectile. Finally, the cost of machining large metal tips from bronze, for example, is inordinately high.

Alternatively, pointed polymer tipped projectiles, such as flat base hollow point projectiles, exposed lead-tip projectiles, metal-tipped projectiles and OTM projectiles, have been used in attempts to achieve the above-stated requirements. But these designs have also failed to achieve those requirements. In general, a common polymer tip has a "head" portion (the relatively sharp, exposed portion in a finished, jacketed or all-copper projectile) and a "shank" portion which is locked in place and hidden from view inside a portion of the projectile's ogive area. An ogive area is a pointed, curved surface used to form an approximately streamlined nose of a projectile. The most common polymers used to make polymer tips are: polycarbonate (classified as an "amorphous" polymer), nylon, and an acetal homopolymer resin sold as DELRIN® by DuPont' (the latter two, classified as "crystalline" polymers). All of these materials, while relatively tough, are also malleable and deformable during a high impact collision such as a projectile striking a fluid-based target.

A polymer tip is generally formed by injection molding and is thereafter inserted and secured within the nose area of the projectile using a crimping or swaging process whereby the fore portion of its shank, just rearward of its tapered head portion, is gripped and held in place by the rim of an open end of a jacket. The shank portion of a polymer tip may comprise a single (cylindrical) diameter or a dual diameter, where the fore portion of its shank is larger than its aft portion. In either case, a portion of the shank is typically centered and held within a cavity formed in a core material of the jacket of the projectile. The core material may provide additional grip to a portion of the shank. In some instances, an air space may exist between the core material and a tail end of the shank of the polymer tip. The air space allows the entire polymer tip to be driven rearward on impact of the projectile with a target, to initiate radial expansion of the projectile within the target. Depending on projectile design and the shank geometry of the tip, an additional air space may exist about a forward portion of the shank.

Polymer tips offer several advantages, including: (1) can be mass-produced quickly and uniformly via injection molding (2) can be molded to precisely match the curvature of the projectile's ogive (3) the radius or flat comprising a meplat of a tip can be relatively small (4) as a result of its low density, even if the polymer tip is slightly askew relative to the projectile axis, it produces almost no adverse aerodynamic effect, (5) unlike soft, lead-tipped projectiles, polymer tips are tougher, and if the tip radius or flat at the extreme tip is large enough, it can resist tip-flattening under recoil when contained in the magazine box of a firearm, (6) polymer materials are relatively inexpensive, and (7) polymer materials provide long-range expansion due to a hydraulic effect within the projectile ogive on impact.

Polymer-tipped projectiles are popular for two reasons: (1) the perception that the sharp tips afforded a higher BC (and therefore maximum velocity retention) over the course of the projectile's flight, and (2) polymers possess the ability to deform on impact and thereby initiate radial projectile expansion, even at long ranges. However, a recent disclosure by the HORNADY® Manufacturing Company (hereafter, HORNADY®) revealed a reduction of the BC of polymer-tipped projectiles occurs over the course of projectile flight. The results of these tests were disclosed by HORNADY® in United States Patent Application 20160169645, Emary, David E.; et al., application Publication No. Ser. No. 14/566,940 (hereafter, "Hornady patent application") as well as in a technical article published by HORNADY® having the title "ELD-X_ELD-Match_Technical_Details.pdf".

HORNADY® tested its own projectiles, as well as, the crystalline polymer-tipped projectiles marketed by its competitors as long range projectiles. The tests were conducted over a long range using Doppler radar. Projectile velocity was recorded at many points along the path of the projectile and it was discovered that the BC decreased steadily as the projectile travelled downrange until the velocity dropped below approximately 2,200 feet per second (fps). The decrease in BC indicates an increase in drag over a segment of the projectile's flight. From those results, it was determined that deformation of the crystalline polymer tip (e.g. softening or melting) created drag that reduced the BC of the projectile. Deformation, such as the softening or melting of the tip in the high temperature supersonic airflow caused the tip to flatten, and thereby increased the frontal area of the tip as the projectile traveled downrange. As a result, the projectile experiences an increase in drag during flight.

Follow-up Doppler radar tests were conducted by HORNADY® using BTHP projectiles with precisely machined metal noses of increasing meplat diameter. All of the projectiles tested were of identical shape other than their nose diameter and all were fired at the same velocity. The downrange results of those tests revealed that the BC of the projectile dropped 6% with a .08 caliber increase in nose diameter. For a .30 caliber projectile, this is a 0.02464-inch increase in the nose diameter.

From these tests, HORNADY® concluded that current designs of crystalline polymer tips suffer from tip melting and flattening above a velocity of 2,400 fps due to aerodynamic heating. At high speeds through the air, a projectile's kinetic energy is converted to heat through compression and friction. Aerodynamic "stagnation temperature" is the temperature that develops at a point (e.g., the meplat area of a projectile tip) directly behind a shock wave in which the air flow is completely stagnant (stopped). The aerodynamic stagnation temperature on the point (meplat) of a projectile at 2,400 fps is approximately 570 degrees Fahrenheit (F). Depending on projectile weight, modern hunting and target rifle cartridges typically produce velocities within 2,800 to 3,200 fps but some, like the 6.5-300 Weatherby Magnum cartridge, for example, can easily propel a 130 grain, high-BC projectile beyond 3,500 fps. The stagnation temperature at 3,500 fps can exceed 1,048 degrees F. Both commercial and "wildcat" varmint cartridges can produce velocities as high as 4,500 fps, which can add greatly to the stagnation temperature, especially if the projectile has a BC above 0.400 G1 (G1 Drag coefficient, hereafter, "G1"). Within a certain time frame, the stagnation temperature on the tip of a projectile traveling 4,500 fps can exceed 1,651 degrees F. At 3,000 fps, the aerodynamic stagnation temperature on the tip of a projectile can be as high as 850 degrees F. At a velocity of 3,120 fps, the peak stagnation temperature can be 2.55 times the melting point of the crystalline polymer, DELRIN®, a common projectile tip material.

The "peak stagnation temperature" achieved during projectile flight is a function of velocity and BC which, together, determine the projectile's time of flight. Each projectile is different and peak stagnation temperature is greatly influenced by flight time as a projectile travels through its particular zone of heating. In short, peak stagnation temperature can be hastened or delayed, and is dependent on a projectile's inherent aerodynamic efficiency and its initial velocity. With respect to time and distance, the HORNADY® tests show that it takes approximately 0.05 to 0.20 seconds, depending on the initial projectile velocity and the projectile's drag, for crystalline polymer tips to begin to deform and/or melt. Based on the flight time range cited above, crystalline polymer tip distortion begins to occur at flight distances of 50-200 yards. The Doppler radar data showed that distortion of the tip (of some unknown shape) continues for up to 500-600 yards, depending on the projectile's aerodynamic properties. The melting of the tip, or other heat-related distortion of the tip, causes the tip diameter (meplat diameter), to become large, which increases the aerodynamic drag on the projectile. The tip deformation manifested in the HORNADY® radar data was concluded based on an increase in the drag coefficient of the projectile at high velocities, which was then maintained for the remainder of the projectile's drag curve.

The most severe tip-heating problem is primarily associated with polymer-tipped projectiles having high BC's, especially those having a BC of 0.550 (G1 drag coefficient, hereafter, "G1") or greater. Generally speaking, polymer-tipped varmint projectiles and conventional, medium-BC (0.400 to 0.500 G1) projectiles are less affected because those projectiles do not typically experience high velocity for a period of time sufficient to cause aerodynamic heating that significantly affects the tip. In the case of a medium-BC projectile at a very high velocity (e.g., 3,900-4,500 fps), the projectile experiences a substantially elevated stagnation temperature that when coupled with increased supersonic airflow pressure acting on the projectile nose, can deform the tip of the projectile, and ultimately lower the BC of the projectile.

Hornady's approach to minimizing tip deformation for a specific velocity range was to use much more expensive polymer tips made from more exotic amorphous polymers such as polyetherimide (PEI), polyphenylsulfone (also known as polyphenylsulphone, PPSU or PPSF), and polysulfone (also known as polysulphone, PSF). Unlike crystalline polymers, amorphous polymers do not have a discreet melting temperature. Amorphous polymers have a sharp glass transition temperature (Tg) but a broad temperature range as it relates to "liquefaction" ("the state of being liquid") which, for all practical purposes herein, can be construed to be the equivalent of melting temperature (Tm) relative to crystalline polymers. The reverse is the trend for crystalline polymers in that crystalline polymers have a narrow Tm and a less sharp Tg. Three of the amorphous polymers HORNADY® selected for use have higher Tg's and higher liquefaction temperatures than the typical crystalline polymers used for projectile tips such as DELRIN® and nylon 6/6, as well as the amorphous polymer, polycarbonate (PC). It should again be stressed, however, that amorphous resins lose their strength quickly above their Tg. This last point is important with respect to the material integrity limitations of even the most robust amorphous polymers available, since their Tg is much lower than their liquefaction temperature. This means that BC-reducing tip deformation can occur in amorphous polymer tips relatively early flight, depending on BC and velocity, just as in the case with traditional, lower-cost crystalline polymer tips due to a tip-softening effect once Tg is reached.

Regardless of the polymer tip material used, the above projectile design did not solve the problem due to stagnation temperature, especially at launch velocities above 2,950 fps. Of the three amorphous polymer tip materials selected for use by HORNADY®, polyphenylsulfone (PPSU, PPSF) has the highest Tg and the highest liquefaction temperature. The other two amorphous polymers selected, polyetherimide (PEI) and polysulfone (PSF), exhibit lower glass transition temperatures and lower liquefaction temperatures, respectively. Thus, at a launch velocity of 2,950 fps, a high-BC projectile with a PPSU or PPSF amorphous tip exceeds not only its Tg of 428 degrees F. (the point at which the tip becomes rubber-like and can deform during projectile flight) but also its liquefaction temperature of 750 degrees F. (the point at which it becomes a liquid and permanently loses its shape). In short, at this velocity, the surface of the tip can begin to liquefy since the stagnation temperature is approximately 770 degrees F. With that in mind, it appears that Hornady's preferred material is PEI. With PEI, the tip deformation problem increases since PEI has an even lower Tg (422.6 degrees F.) and an even lower liquefaction temperature (735.8 degrees F.). The third HORNADY® polymer, PSF, has a significantly lower Tg and liquefaction temperature than PEI. In any case, even though these amorphous polymers are more robust relative to temperature, the polymers ultimately suffer from the same tip deformation problem as crystalline polymers. For example, the tip-deformation problem caused by stagnation temperatures becomes much worse as muzzle velocity is increased above 2,950 fps. In particular, a projectile moving at 2,950 fps can experience a peak stagnation temperature of 1.13 times the liquefaction temperature of the amorphous polymer, such as PEI. In addition, high ambient temperature conditions can further increase the peak stagnation temperature that the projectile experiences over the course of its flight, and thereby increasing tip deformation of the polymer-tipped projectile.

Figure 2:
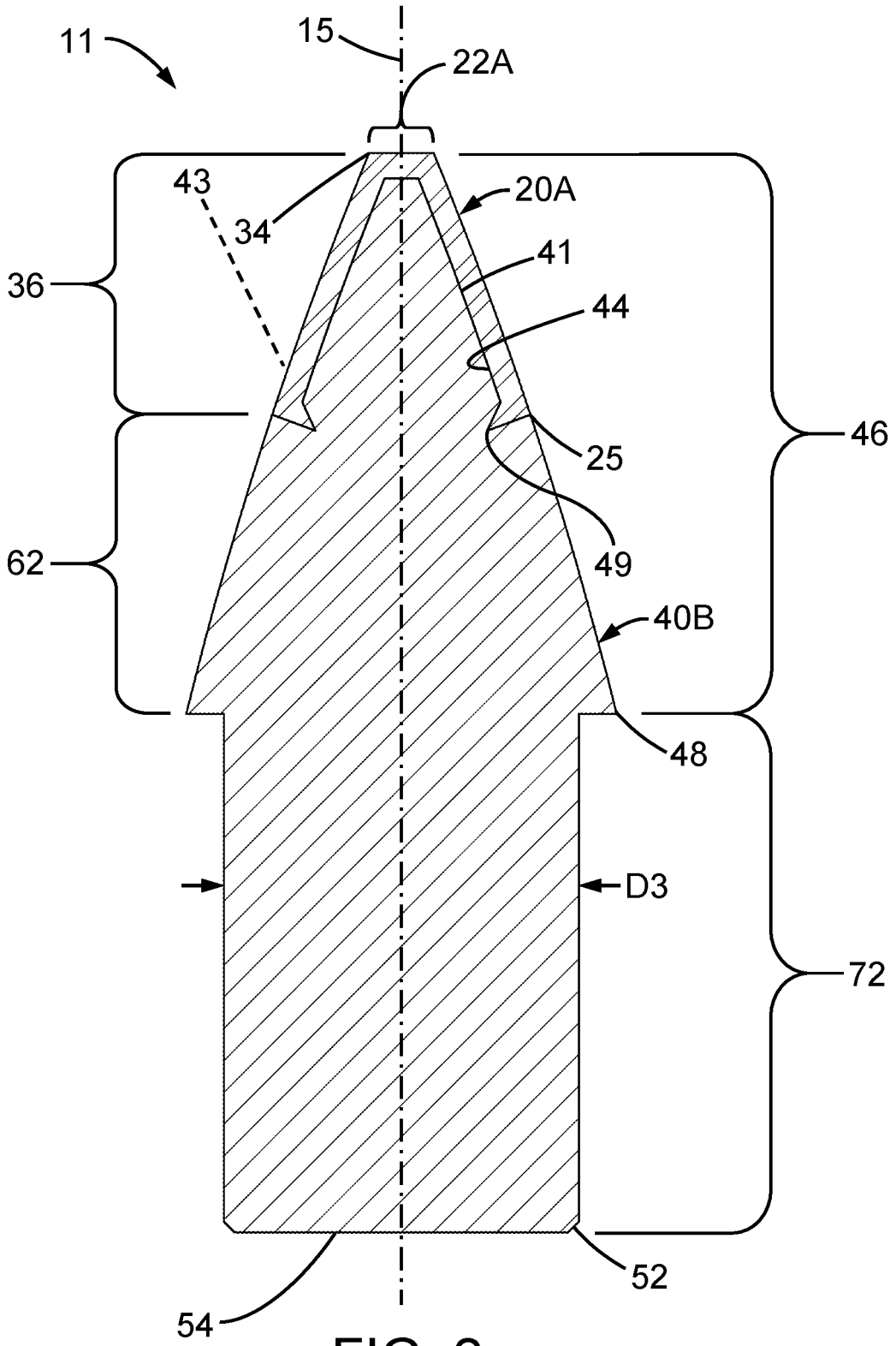
FIG. 2 is a longitudinal cross-sectional view of a nose insert for a projectile including a polymer nose element and a metal cap, in accordance with another embodiment of the present disclosure.
Figure 3:
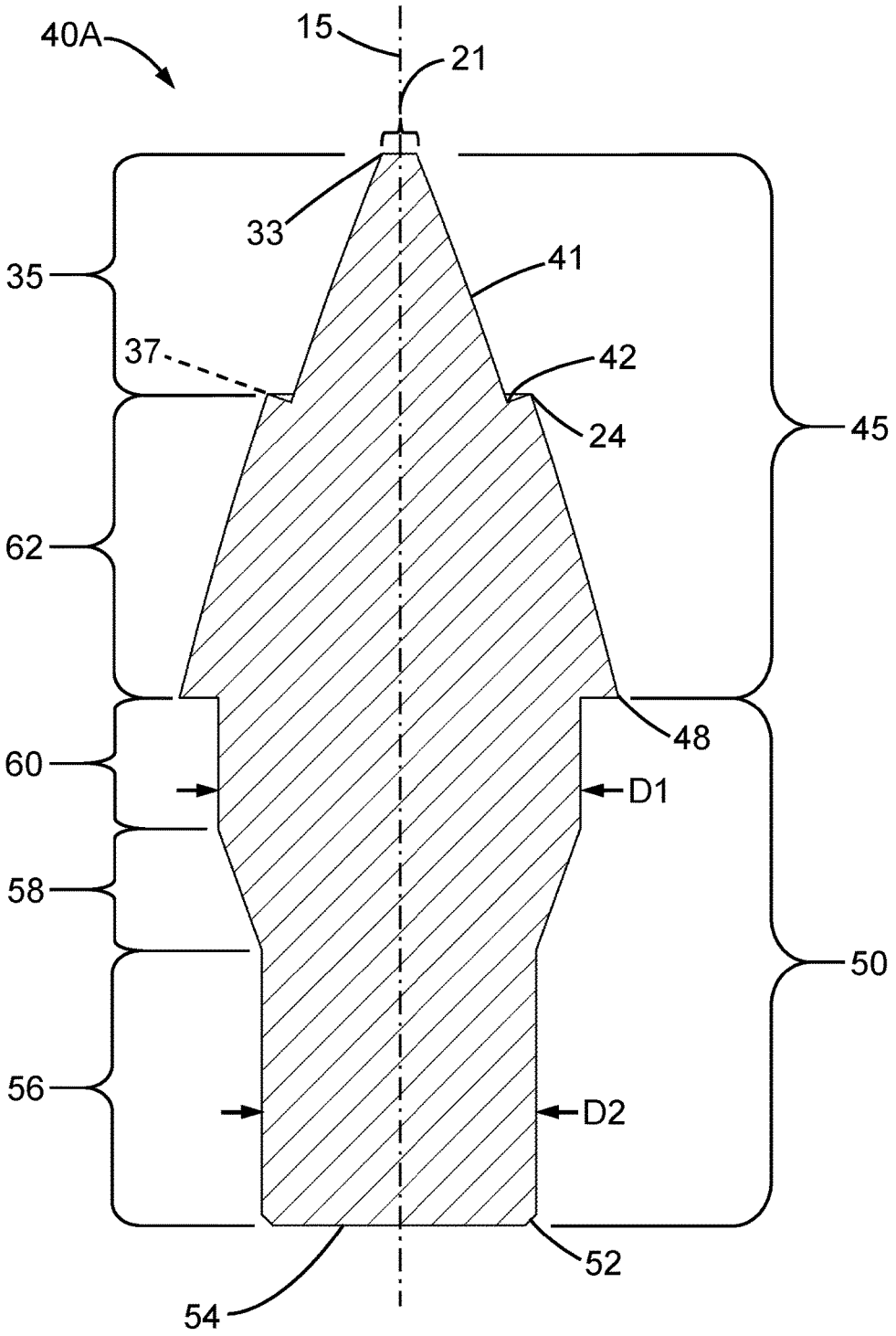
FIG. 3 is a longitudinal cross-sectional view of the polymer nose element of the nose insert shown in FIG. 1, in accordance with an embodiment of the present disclosure.

The FIG. 3 of the HORNADY® patent application, shows a start velocity of Mach 2.5. Mach 2.5 is equivalent to 2,791.093 fps. While this graph shows a difference in drag between DELRIN® and PEI, the actual difference in drag and the corresponding difference in velocity between the two tip materials are not extreme. Regarding the HORNADY® test parameters described in its two publications, it is important to note that no launch velocity exceeding 3,000 fps (Mach 2.687) is mentioned. The highest Mach number reflected in FIG. 2 (Cd vs. Mach) of the HORNADY® technical article is approximately 2.63 (2,936.229 fps) an indication that at higher velocities the more robust amorphous polymers exceed their maximum velocity threshold with respect to shape retention of the tip and no longer yield a meaningful BC advantage because the tip has begun to liquefy. The scope of the amorphous tip deformation problem is underscored by the fact that modern hunting and target rifle cartridges typically produce velocities within the 2,800 to 3,200 fps range. With that in mind, the meplat area of an amorphous tip in a high-BC projectile is not going to survive velocities equal to or greater than 3,000 fps without experiencing degradation (e.g., deformation) since the stagnation temperature at this velocity according to the HORNADY® patent application is approximately 450 degrees Celsius (C) (842 degrees F.) which exceeds the limits of amorphous polymer integrity due to its 750 degrees F. liquefaction temperature.

At this juncture, it should be noted that even though Doppler radar can record a projectile's drag and velocity at many points over the course of its flight (starting at about 50 yards downrange from the radar head), deformation of the polymer tip is not visible to the human eye. In light of that shortcoming, Doppler radar is, in a sense, "blind" technology. The only way polymer tip deformation of 0.025 of an inch or less can be clearly seen with sufficient resolution is with ultra-high-speed ballistic photography. Photographs showing detailed tip deformation can be obtained by employing an ultra-high-speed flash unit having a 500 nanosecond exposure time (or faster) and a high resolution digital camera of 24 megapixels (or greater) and equipped with a macro lens having a reproduction ratio of 1:1. Additionally, a high-speed trigger system having a very quick response time (e.g., 1 microsecond) needs to be employed in order to trigger the flash in a timely manner as the projectile passes through the flash zone. Even with such equipment, the photographs would need to be recorded at night or under extremely subdued light conditions at the actual projectile range (e.g., 200-1000 yards). High-speed photography of a polymer tip deforming or melting in flight, however, is difficult at extended ranges. In light of this, there is no concrete evidence regarding the degree to which polymer tips (whether crystalline or amorphous) deform in flight. All that is known as a result Hornady's Doppler radar tests is that a polymer tip in a high-BC projectile can be deformed to some unknown shape and degree once a certain velocity threshold is met or otherwise exceeded.

In light of the aforementioned polymer tip shortcomings, a need exists for a new and improved nose insert for a projectile that withstands sustained high stagnation temperatures that occur over long-range projectile flight at speeds between 2,400 fps and 4,500 fps, while maintaining a high BC over the course of the projectile's travel. The various embodiments of the present disclosure fulfill this need.

The present disclosure provides an improved nose insert for use with a projectile comprising a polymer nose element and a metal cap which overcomes the abovementioned disadvantages and drawbacks of the prior art; as well as a projectile utilizing the improved nose insert. Generally speaking, the present disclosure provides a two-component, heat mitigating nose insert including a resilient polymer nose element with an attached metal cap at its forward end for use in a projectile. The nose insert of the present disclosure provides advantages over previous nose insert designs. For example, a nose insert in accordance with an embodiment of the present disclosure provides substantially improved long range aerodynamic drag due to its ability to prevent heat-related tip deformation during high velocity flight over great distances. In addition, nose insert configurations as disclosed herein also provide improved projectile expansion (or mushrooming) ability upon impact at long range beyond that of previous nose insert designs. In other words, the two-component nose insert of the present disclosure provides a hybrid tip that outperforms conventional, single-material tips by eliminating all adverse tip deformation and melting which is a common problem associated with currently available all-polymer tips when used in medium to high-BC projectiles launched at high velocity.

In an example embodiment of the present disclosure the nose insert includes an elongated polymer nose element and an attached protective metal cap that does not melt at realistically attainable high flight speeds. The attached protective metal cap can be, for example, folded-on, crimped-on, swaged-on or molded-in (e.g., insert molded). When assembled, the mating surfaces of the two components remain in contact with one another, and together, form a single unit (a nose insert), the shank portion of which can be centrally secured in a projectile, adjacent a portion of the projectile's ogive. The polymer nose element can be a crystalline or an amorphous polymer material comprising a tapered head portion having two distinct curved portions geometrically separated from one another by a narrow shoulder, wherein the radius of the forward curved portion is smaller than the radius of the rear curved portion, and wherein the greatest width of the rear curved portion forms a wider shoulder connected to a cylindrical shank portion. The cylindrical shank portion can comprise two diameters or a single diameter. The wider shoulder at the rear of the tapered head lies along a plane which is substantially perpendicular to the axis of the polymer nose element, while the narrower shoulder is defined by an inwardly sloping angle that is less than perpendicular to the axis of the polymer nose element. The inwardly sloping angle of the narrower shoulder can be between about 20 and 45 degrees, depending on the ogive radius of the projectile in which the nose insert resides. The forward curved portion of the tapered head portion can terminate in a flat end or a spherical end.

The metal cap portion of the nose insert can be aluminum, aluminum alloy, copper, copper alloy, bronze, brass, mild steel, stainless steel or any metal having a sufficiently high melting temperature. In an example embodiment, the metal cap material is aluminum. The metal cap configuration is tapered and can be formed in a series of steps starting with a thin disk of metal (not shown) in which a sharp, circumferential locking ridge is formed in one face of the disk by way of a modified coining operation. The sharp, circular locking ridge can have an interior angle of between about 20 and 45 degrees which ultimately serves to lock the nose insert components together. After the metal disk is forced into a tapered die, a cap-like pre-form (not shown) is produced having a tapered outer curvature, a closed front end, and an open rear end which is wide enough to provide clearance between the greatest width of the forward curved portion of the polymer nose element and the sharp, inner locking ridge in the metal pre-form. In a final step, the metal pre-form is inserted in a die, followed by insertion of the polymer nose element, after which, sufficient axial force is applied to the shank of the polymer nose element to attach the two components together. During this step, a folding or crimping action occurs whereby the sharp, inner locking ridge is forced radially inwardly, circumferentially penetrating the polymer nose element at its narrow shoulder area, and permanently securing the tapered metal cap to the front of the polymer nose element. During this penetration process, the interior angle of the sharp, circular locking ridge causes the polymer nose element to be drawn towards the rear of the metal cap which minimizes any gap between the two components. Once attached and in final form, the metal cap will have a tapered outer curvature that matches the larger, rear curvature portion of the polymer nose element (i.e., both components will share a common radius). The wall thickness of the metal cap can be between about 0.005 of an inch and 0.020 of an inch. The tapered metal cap can terminate at a forward end with a meplat that is flat or includes a radius. In either case, the flat or radius can be extremely small (i.e., forming a sharp point), which ultimately maximizes the BC of a projectile containing the nose insert of the present disclosure.

In another example embodiment, the present disclosure also discloses a projectile that includes the nose insert, as described herein. In an example embodiment, the projectile includes an elongated projectile body, the body having a forward end, a rear end opposite the forward end, and an intermediate cylindrical portion between the rear and forward ends. The front end of the body defining a cavity, wherein at least a portion of the nose insert is received in the cavity.

Additional features of the present disclosure exist and will be described hereinafter and which will form the subject matter of the attached claims.

These and various other advantages, features, and aspects of the embodiments will become apparent and more readily appreciated from the following detailed description of the embodiments taken in conjunction with the accompanying drawings, as follows.

Example Projectile and Nose Insert Configurations

FIG. 1 is a longitudinal cross-sectional view of a nose insert 10 for a projectile including a polymer nose element 40A and a metal cap 20A, in accordance with an embodiment of the present disclosure. In the example embodiment, the nose insert 10 includes a resilient polymer nose element 40A and a metal cap 20A. The polymer nose element 40A can be manufactured from either a crystalline or an amorphous polymer, for example by injection molding techniques.

The polymer nose element 40A is configured to receive metal cap 20A to form the nose insert 10. In general, the size and shape of the polymer nose element 40A are both dependent on projectile caliber, ogive type (e.g., tangent or secant) and the ogive radius of the specific projectile to which the polymer nose element 40A is to be installed. For instance, the polymer nose element 40A, in some examples, can be configured to receive the metal cap 20A, such that an outer surface profile among the polymer nose element 40A, cap 20A, and the projectile is consistent or otherwise uniform. To this end, the mating surfaces 41 and 44 of the polymer nose element 40A and metal cap 20A (respectively) can be configured so that a curved or tapered portion 36 of the metal cap 20A can be flush with the outer surface of the rear curved or tapered portion 62 to provide a uniform outer surface profile upon installation of the cap 20A onto the polymer nose element 40A. Moreover, the polymer nose element 40A, in some examples, can be configured such that the metal cap 20A substantially covers or otherwise surrounds the outer surface 41 of the smaller, forward curved or tapered portion 35 of the tapered head portion 45 (as shown in FIG. 3). In some examples, the forward tapered portion 35 is configured so that it is partially covered by the metal cap 20A. The mating surfaces 41 and 44 of the polymer nose element 40A and the metal cap 20A (respectively) can be in partial or full contact with one another, depending on the application.

The polymer nose element 40A is further configured to be received within a jacket of a projectile so as to secure the nose insert 10 within the projectile, as described further below. The polymer nose element 40A, in some examples, includes a wide shoulder 48 configured to engage one or more surfaces of the jacket of a projectile. In particular, the wide shoulder 48 can be configured to mate or otherwise engage a rim of a jacket to form a projectile. The wide shoulder 48, in some examples, can also define a maximum width of the rear tapered portion 62 of tapered head portion 45. In one example, the wide shoulder 48 is a flat surface that is perpendicular to the central axis 15. The wide shoulder 48, in some examples, can be parallel to the narrow shoulder 24 at the forward end of the polymer nose element 40A. The wide shoulder 48, in some examples, can be inclined or otherwise tapered relative to the central axis 15 to receive an inclined surface profile of a rim of the jacket of the projectile.

Figure 5:
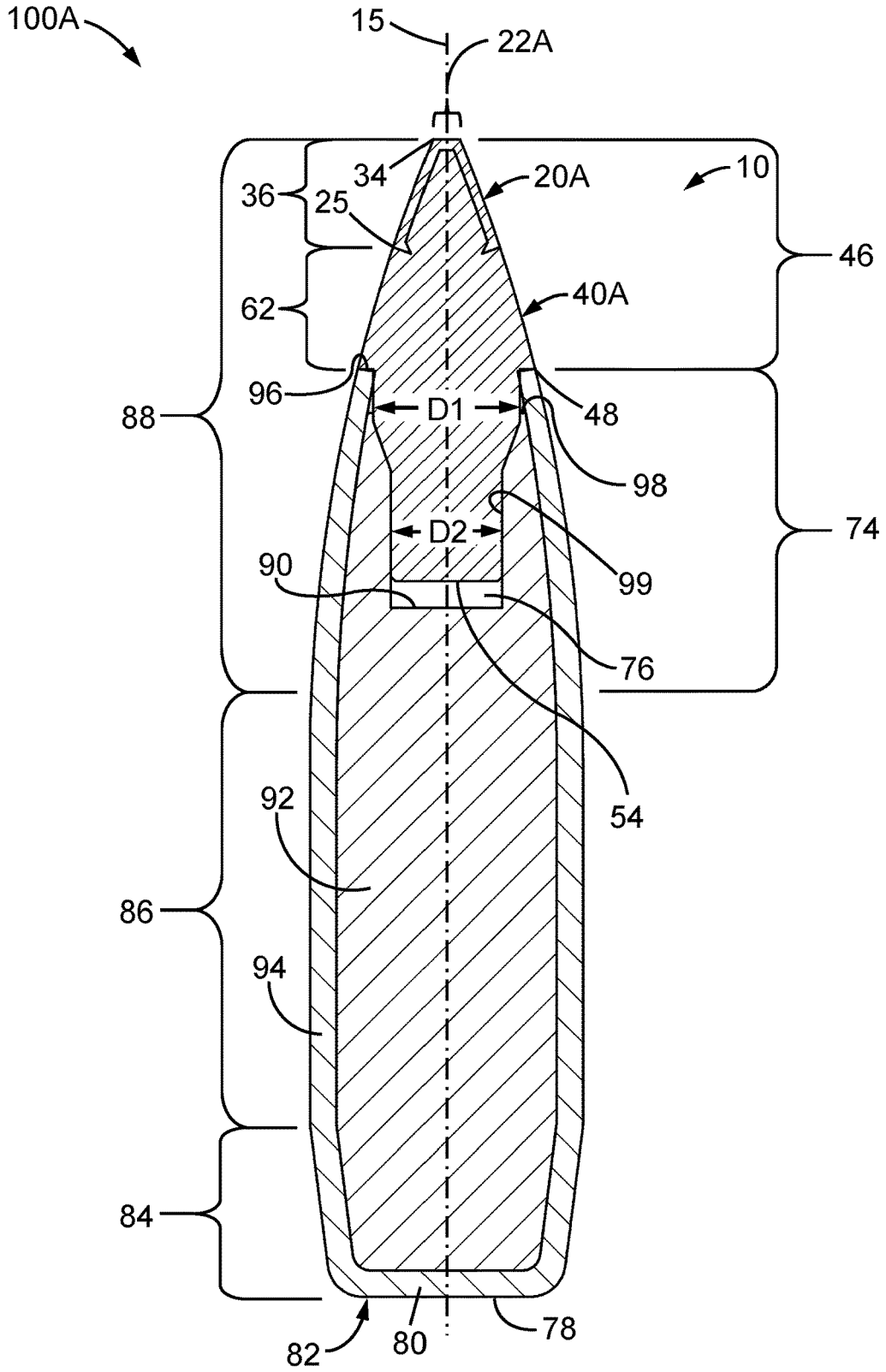
FIG. 5 is a longitudinal cross-sectional view of a projectile including a nose insert and a jacket in accordance with an embodiment of the present disclosure.
Figure 6:
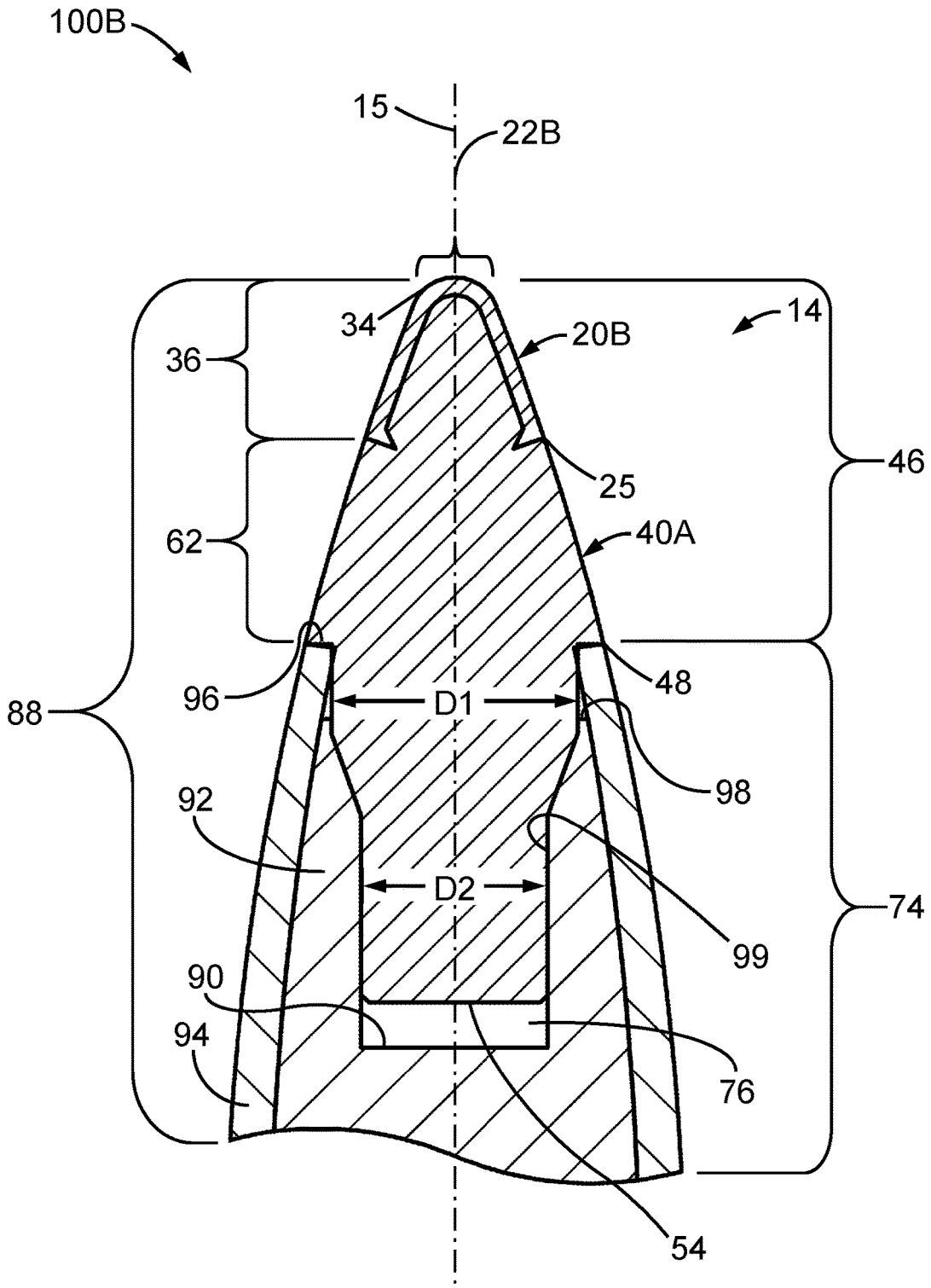
FIG. 6 is a partial longitudinal cross-sectional view of a projectile that includes a nose insert in accordance with another embodiment of the present disclosure.
Figure 7:
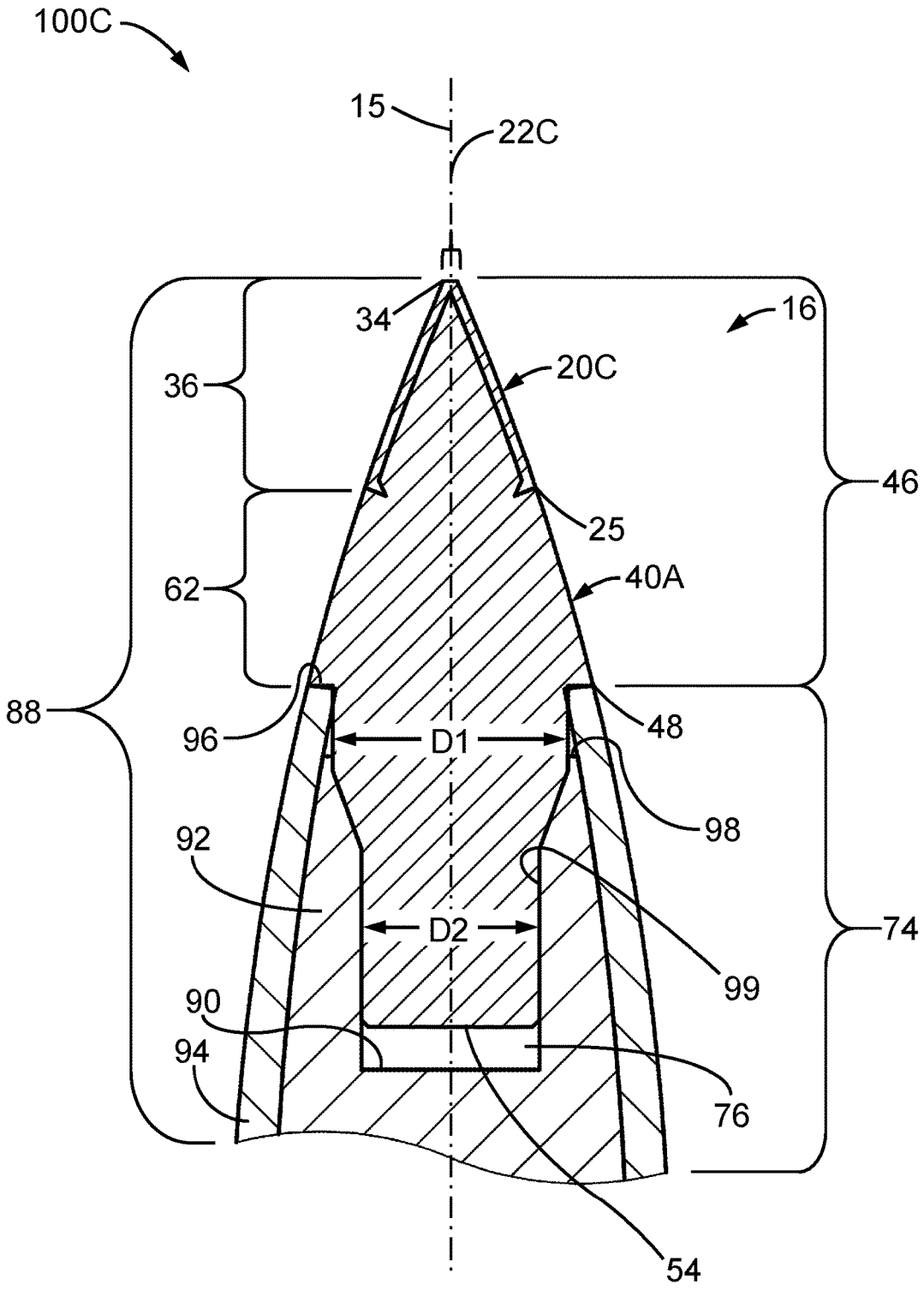
FIG. 7 is a partial longitudinal cross-sectional view of a projectile that includes a nose insert in accordance with another embodiment of the present disclosure.

The polymer nose element 40A also includes a shank portion 50 that engages or otherwise attaches to the jacket of the projectile, as described further herein. Generally speaking, the shank portion 50 can have any size and/or shape so that the shank portion 50 can contact one or more internal surfaces of the jacket. In some examples, as shown in FIGS. 1 and 3, the dual-diameter shank portion 50 of the polymer nose element 40A comprises three portions 60, 58 and 56, and two distinct diameters, D1 and D2. The first shank portion 60 is adjacent to the wide shoulder 48 of the polymer nose element 40A and has the larger shank diameter D1. Continuing rearward, the next portion of the shank portion 50 consists of a tapered portion 58 which connects the larger diameter D1 of the shank portion 50 with the rearmost portion 56 which has a smaller shank diameter D2 than diameter D1. A chamfer 52, or a radius (not shown) can exist at the rear 54 of the shank portion 50 of the polymer nose element 40A, which assists in guiding and centering the polymer nose element 40A, or the assembled nose insert 10, into a central cavity 99 within the core 92 of the projectiles 100A-100C as shown in FIGS. 5-7, respectively. The shank portion 50, in some other examples, can include a cylindrical or rectangular cross-sectional shape, and include uniform dimensions (e.g., a diameter). Numerous other polymer nose element configurations will be apparent from the present disclosure.

The nose insert 10 further includes a metal cap 20A configured to reduce aerodynamic drag caused by heat-related tip deformation. In more detail, the metal cap 20A can be manufactured from metals having a higher melting temperature than polymer materials and retain their shape (and rigidity) at higher temperatures than polymer materials. When used for its intended purpose as expressed herein, the metal cap 20A does not soften or otherwise melt and thereby prevents deformation and melting caused by high stagnation temperatures developed during high speed flight. The high melting temperature of the metal cap 20A ensures that a high projectile BC is maintained over the entire course of the flight of the projectile. In addition, the metal cap 20A also shields and thereby protects the underlying lower melting temperature polymer material in the forward tapered portion 35 of the polymer nose element 40A from melting and other heat-related deformation. In an example embodiment, the metal cap 20A material is aluminum due to its low cost, light weight, malleability and relatively high melting temperature. In other embodiments, materials, such as an aluminum alloy, bronze, brass, copper (or alloys thereof), mild steel, stainless steel or any metal having a sufficiently high melting temperature can be used to manufacture the metal cap 20A. Thus, the minimum melting temperature of the metal cap 20A, in some examples, can be 1200 degrees F. In other examples, the melting temperature of the metal or alloy can be greater than or equal to 1000 degrees F., 1100 degrees F., 1200 degrees F., 1300 degrees F., 1400 degrees F. or 1500 degrees F.

TABLE 1

Melt points of metals, melt points, liquefaction points and glass transition points of polymers

| METAL | Melting Point | — |
|---|---|---|
| stainless steel | 2750° F. | — |
| mild steel | 2600° F. | — |
| copper | 1983° F. | — |
| brass | 1710° F. | — |
| bronze | 1675° F. | — |
| aluminum | 1220° F. | — |
| **POLYMER** | **Liquefaction Point Melting Point** | **Glass Transition Point** |
| PEI | 736° F. | 422.6° F. |
| nylon 6,6 | 509° F. | 296.6° F. |
| DELRIN ® | 335° F. | −76° F. |
| PC | 311° F. | 122° F. |

Table 1 shows the melting points of various metals that can be used in the present disclosure, the melting points of two crystalline polymers, the liquefaction points of two amorphous polymers, and the glass transition temperature Tg of the four polymers cited herein. It will become readily apparent from Table 1, as well as the graph shown in FIG. 8, that even the metal with the lowest melting point shown (aluminum), has a very great advantage over all of the polymer types listed, including PEI, with respect to melting temperature. The melting point of aluminum is 1220 degrees F. whereas the liquefaction point of PEI is 736 degrees F. The temperature differences shown in Table 1 are important with respect to stagnation temperature. For instance, PEI will liquefy at less than 3,000 fps whereas aluminum will withstand a velocity of over 3,800 fps before melting. PEI will also exhibit soft, rubbery deformation properties at only 422.6 degrees F. The metals listed in Table 1, on the other hand, exhibit no such softening effect at such temperatures. Furthermore, it should be understood that a high-BC projectile can achieve a stagnation temperature of 422.6 degrees F. at a velocity of only 2,200 fps. This means that PEI can deform in flight at slightly higher velocities than 2,200 fps as a result of its Tg. With respect to stagnation temperatures, it should also likewise be understood that no high-BC projectile available can melt an aluminum tip since such projectiles cannot travel at a velocity of 3,800 fps because of the length and weight of the projectile. In other examples, if the metal cap 20A is made of copper, low and medium-BC projectiles could travel at nearly 4,950 feet per second without melting. Furthermore, if the metal cap 20A is made of stainless steel, low or medium-BC projectiles could travel at over 5,900 feet per second without melting.

Figure 4:
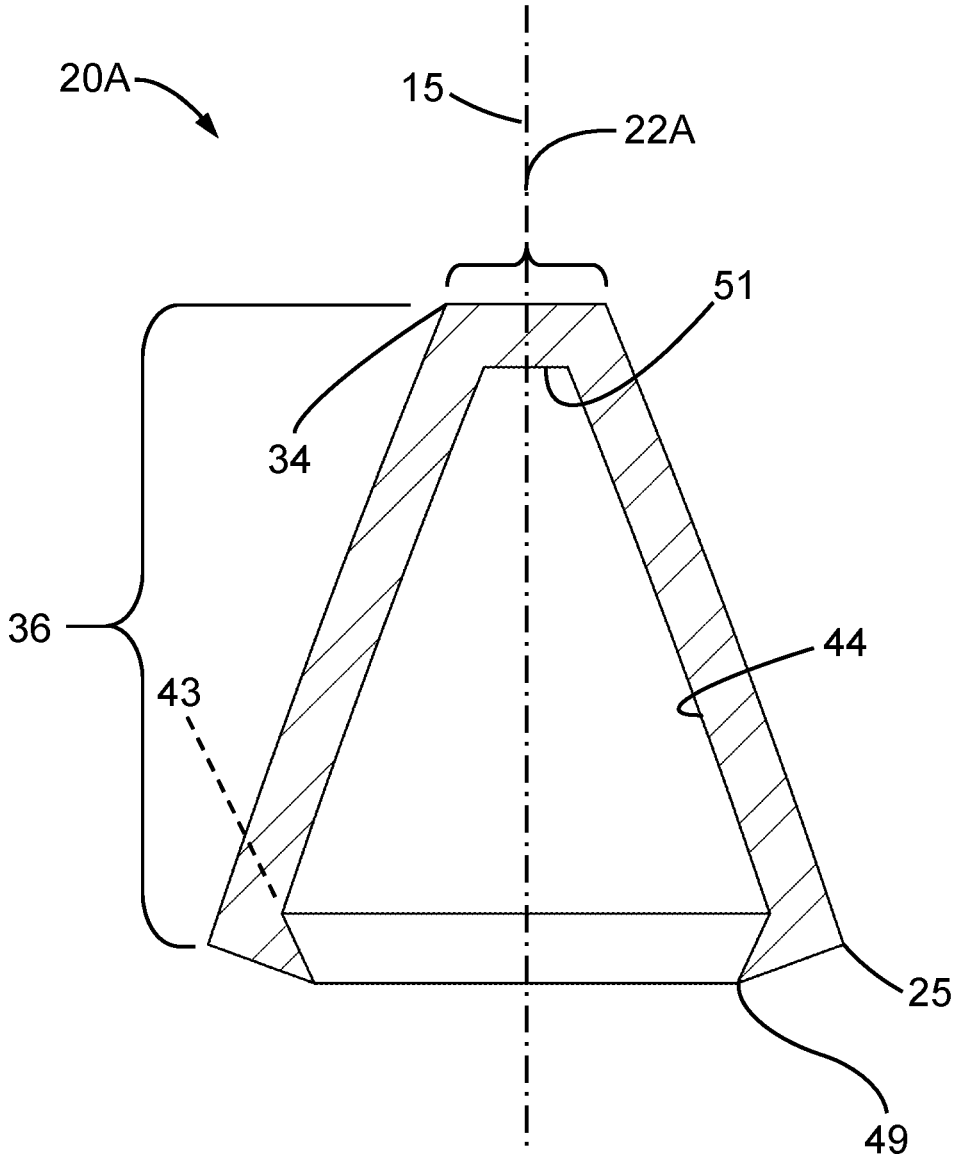
FIG. 4 is a longitudinal cross-sectional view of the metal cap of the nose insert shown in FIGS. 1-2, in accordance with an embodiment of the present disclosure.

As is the case with the polymer nose element 40A, the size and shape of the metal cap 20A are both dependent on projectile caliber, ogive type (tangent or secant) and the ogive radius of the specific projectile to which the metal cap 20A is to be installed. The general shape and features of the metal cap 20A are shown in FIGS. 1, 2, and 4. The metal cap 20A includes basic features such as a curving or ogival tapered portion 36 (the radius of which matches that of the projectile it will ultimately reside in, as well as the radius of the rear tapered portion 62 of the tapered head portion 45 of the polymer nose element 40A), a meplat 22A at the forward terminus 34 of the metal cap 20A, an outer shoulder 25, and a sharp, locking ridge 49. The axial height of the tapered portion 36 of the metal cap 20A may be less than, equal to or greater than the axial height of the forward tapered portion 35 of the tapered head portion 45 of the polymer nose element 40A.

Furthermore, in some examples, the tapered portion 36 of the metal cap 20A and the rear tapered portion 62 of the tapered head portion 45 of the polymer nose element 40A essentially share a common ogive radius 46 which results in a relatively smooth and continuous curvature between components. In more detail, the tapered portion 36 of the metal cap 20A terminates at its forward terminus 34 in a meplat, and terminates at its rear end in an outer shoulder 25. If desired, a small air space can exist rearward of an area 51 on the interior wall 44 of the metal cap 20A and forward of the forward end 33 of the smaller, forward tapered portion 35 of the tapered head portion 45 of the polymer nose element 40A.

FIG. 2 is a longitudinal cross-sectional view of a nose insert 11 for a projectile including a polymer nose element 40B and a metal cap 20A, in accordance with another embodiment of the present disclosure. The metal cap 20A has been previously described in relation to FIG. 1. Furthermore, many of the features of the polymer nose element 40B have been previously described in relation to polymer nose element 40A shown in FIG. 1. As can be seen, the polymer nose element 40B includes a shank portion 72 instead of a dual diameter shank portion 50 of polymer nose element 40A of nose insert 10. The shank portion 72, in some examples, includes a cylindrical cross-sectional shape with a diameter D3 over its entire length, with the exception of a chamfer 52 or a radius (not shown) that can exist at the rear 54 of the shank portion 72 of the polymer nose element 40B. As a result of its uniform shape, the shank portion 72 allows lower velocity projectiles to expand or mushroom more readily upon impact at extended ranges because the polymer nose element 40B includes more material in which to cause expansion of the projectile.

FIG. 3 is a longitudinal cross-sectional view of the polymer nose element 40A of the nose insert 10, in accordance with an embodiment of the present disclosure. In an example embodiment, the polymer nose element 40A can be injection molded using any crystalline or amorphous polymers. Crystalline polymers such as DELRIN® are less expensive than amorphous polymers like PEI. It should be noted that the current cost of PEI per pound is $8.80 versus the current cost of DELRIN® which is $1.39 per pound. The difference in cost between the polymer types and the metals cited herein can be found in Table 3.

Again, the size and shape of the polymer nose element 40A are both dependent on projectile caliber, ogive type (e.g., tangent or secant) and the ogive radius of the specific projectile to which the polymer nose element 40A is to be installed. As shown in FIG. 3, the polymer nose element 40A, in this one example, has a tapered head portion 45 including two distinct tapered portions, 62 and 35 and a shank portion 50. The larger, rear tapered portion 62 of the tapered head portion 45 terminates in a wide shoulder 48 at its rear end, and terminates in a narrow shoulder 24 at its forward end. The larger, rear tapered portion 62 of the tapered head portion 45 is defined by a radius that can be the same as the radius of the projectile ogive. The smaller, forward tapered portion 35 of the tapered head portion 45 is defined by a radius smaller than the larger, rear tapered portion 62. The smaller, forward tapered portion 35 of the tapered head portion 45 terminates at its rear end at location 42 and terminates at its forward end 33 in a flat end 21 or other geometry, such as a rounded or pointed end, depending on the desired shape of the meplat 22A of the metal cap 20A (shown in FIG. 1). In addition, the outer surface 41, in some examples, can be recessed below an outer surface of the rear tapered portion 62 to allow the outer surface of tapered portion 36 of the metal cap 20A to be flush with an outer surface of the rear tapered portion 62 of the polymer nose element 40A, upon installation of the metal cap 20A onto the polymer nose element 40A. Moreover, the outer surface 41, in some examples, can be a uniform surface having a constant slope, such as 25, 30, 45, 50, 60, or 75 degrees, relative to the central axis 15. In some other examples, the outer surface 41 can have a varying slope along its length. For example, a forward portion of the outer surface 41 can have a greater slope relative to the central axis 15 than an aft portion of the outer surface 41. In addition, the wide shoulder 48 at the rear of the larger, rear tapered portion 62 of the tapered head portion 45 lies along a plane which is substantially perpendicular to the central axis 15 of the polymer nose element 40A, while the narrow shoulder 24 is defined by an inwardly sloping angle that is not perpendicular to the central axis 15 of the polymer nose element 40A. The inwardly sloping angle 37 (indicated by a broken line) of the narrow shoulder 24 can be between about 20 and 45 degrees. As can be seen, the narrow shoulder 24, in some examples, can be extend from the outer surface of rear tapered portion 62 to location 42 in a downwardly sloping direction relative to a forward end 33, as shown in FIG. 3.

FIG. 4 is a longitudinal cross-sectional view of the metal cap 20A of the nose insert 10, in accordance with an embodiment of the present disclosure. In an example embodiment, the metal cap 20A is manufactured from aluminum. It should be noted that the metal cap 20A is a very small, lightweight component and thousands of caps be produced from one pound of low-cost metal such as aluminum. Depending on the metal cap 20A style, its axial height and wall thickness as depicted in FIGS. 5-7, between about 6,000 and 12,000 metal cap components can be produced from a one-pound sheet of aluminum. Furthermore, the metal cap 20A may be anodized, dyed or colored using any process or means available.

The metal cap 20A includes a locking ridge 49 for securing the metal cap 20A to the polymer nose element 40A. In this one example, the locking ridge 49 is a circular ridge that extends from an interior wall 44 so as to engage the forward tapered portion 35 of the polymer nose element 40A. The locking ridge 49 can extend along an entire circumference of the interior wall 44 to form a circular locking ridge, as shown in FIG. 4. In some other examples, the locking ridge 49 may extend along a portion of the interior wall 44. For instance, the locking ridge 49 may be a plurality of individual ridges that are spaced apart from one another, for example at 90-degree intervals. The plurality of individual ridges may provide additional surface area in which to engage the forward tapered portion 35 of the polymer nose element 40A to securely fasten the metal cap 20A to the element 40A. In addition, the locking ridge 49 can extend from a rear portion of the interior wall 44, such that an outer shoulder 25 of the metal cap 20A forms part of the ridge 49.

The thickness of the metal cap 20A promotes improved BC characteristics of the projectile by reducing weight of the nose insert. For instance, in some examples, the average wall thickness of the metal cap 20A can be between about 0.005 inch and 0.020 of an inch. In other embodiments the wall thickness may be less than 0.05 inch, less than 0.04 inch, less than 0.03 inch or less than 0.02 inch. In additional embodiments the wall thickness may be greater than 0.003 inch, greater than 0.005 inch, greater than 0.01 inch or greater than 0.02 inch. Average wall thickness can be measured at a midpoint between the front and the back of the metal cap. In some embodiments, the wall thickness is consistent along the length of the metal cap 20A. In other cases, the wall thickness may vary along the length of the cap and may be, for example, thicker at the front than the rear or thinner at the front than the rear. When there is a change in thickness, the change may be gradual or may be stepped.

The shape of the metal cap 20A can also improve the BC of the projectile. For example, the metal cap 20A can terminate at is forward terminus 34 with a meplat 22A that is flat or includes a radius. In either case, the flat or radius can be small (i.e., forming a sharp point), which ultimately maximizes the BC of a projectile utilizing the nose insert 10 of the present disclosure. The metal cap 20A can assume various shapes and sizes, depending on the desired projectile type. The axial height of the metal cap 20A, the lateral width of the outer shoulder 25, the radius of its tapered portion 36, and the diameter of the meplat 22A can all vary, dimensionally. In particular, the diameter of the meplat 22A can be small (e.g., 0.010 inch or smaller) as depicted in FIG. 7, or as wide as 0.060 of an inch or wider as generally depicted in FIG. 5.

Furthermore, the diameter of the meplat 22A in the metal cap 20A is important from an exterior ballistic standpoint. The smaller the meplat 22A diameter (i.e., the more sharply pointed), the higher the BC of the projectile. Maintaining a sharp point at the extreme tip of a projectile in flight can improve the BC of the nose insert. Importantly, unlike an all-polymer tip, the size of the meplat 22A in the metal cap 20A can be any diameter (e.g., extremely pointed) and yet not deform under recoil when contained in the magazine box of a firearm, because of the greater hardness of metal versus plastic materials. Furthermore, the sharpness of the meplat 22A of the metal cap 20A can be preserved and unaffected during assembly by using a seating punch having a central cavity which prevents the meplat 22A from ever contacting the seating punch itself.

TABLE 2

The Effect Meplat Diameter Has On BC

| 165 grain 30 Caliber Projectile (6-S Tangent Ogive) | Meplat Diameter | BC |
|---|---|---|
| Example 1 | .091 | 0.3593 |
| Example 2 | .081 | 0.369 |
| Example 3 | .071 | 0.378 |
| Example 4 | .061 | 0.3862 |
| Example 5 | .051 | 0.3934 |
| Example 6 | .041 | 0.3995 |
| Example 7 | .031 | 0.4045 |
| Example 8 | .021 | 0.4081 |
| Example 9 | .011 | 0.4104 |
| Example 10 | .001 | 0.4112 |

Table 2 shows the effect that meplat diameter has on BC. Specifically, the table shows how the BC of a 30 caliber, 165 grain, flat-based projectile having a 6-S tangent ogive can be raised by reducing the size of the meplat 22A in 0.010 inch increments. A 6-S tangent ogive is a rather modest profile in a projectile of this caliber and weight, which is to say that it does not have an inherently high BC. Even in light of the 6-S ogive limitation, however, a significant difference in BC of 0.0519 results by reducing the meplat diameter from 0.091 to 0.001 of an inch. This is a BC increase of nearly 14.5 percent. On the other end of the BC spectrum, when a very small meplat (e.g., between 0.001 and 0.010 of an inch) is used in conjunction with a long, heavy projectile having a very sharp secant ogive and a boat tail, the BC can be improved to a very pronounced and meaningful degree.

In one set of embodiments, the method of metal cap 20A manufacture begins by coining a flat, thin disk (not shown), followed by forming a cap-like pre-form (not shown) within a tapered die wherein an external curvature is created. A sharp, circumferential locking ridge is formed in one face of the disk by way of a modified coining operation (not shown). The sharp, locking ridge 49 can have an interior angle 43 of between about 20 and 45 degrees relative to the central axis 15 (as depicted by broken line) which ultimately serves to lock the two nose insert components together after assembly. After, the metal disk is forced into a tapered die, a cap-like pre-form is produced having a tapered outer curvature, a closed front end, and an open rear end which is wide enough to provide clearance between the greatest width of the smaller, forward tapered portion 35 of the tapered head portion 45 of the polymer nose element 40A (as shown in FIG. 3) and the sharp, locking ridge 49 in the metal pre-form. Next, the metal pre-form is inserted in a die (not shown), followed by insertion of the polymer nose element 40A, after which, axial force is applied to the shank portion 50 of the polymer nose element 40A to attach the two components together. During this step, the metal cap 20A can be mechanically folded, crimped, or swaged onto the smaller, forward tapered portion 35 of the polymer nose element 40A (shown in FIG. 3) or attached by way of insert molding. For example, when the metal cap 20A is folded around the smaller, forward tapered portion 35 of the tapered head portion 45 of the polymer nose element 40A (as shown in FIG. 3), the sharp, locking ridge 49 is forced radially inwardly, circumferentially penetrating the polymer nose element at location 42 just rearward of its narrow shoulder 24 (as shown in FIG. 3), thereby permanently securing the metal cap 20A to the front of the polymer nose element 40A. During this process, the interior angle 43 of the sharp, circular locking ridge 49 (as shown in FIG. 4 and indicated by a broken line) causes the polymer nose element 40A to be drawn towards the outer shoulder 25 at the rear of the metal cap 20A (as shown in FIG. 4) which minimizes any gap between the two components. Once final-formed and attached, the metal cap 20A can include a curved or tapered portion 36 that matches the larger, rear tapered portion 62 of the polymer nose element 40A (i.e., both components share a common radius).

If the metal cap 20A is mechanically folded (or crimped) onto the smaller, forward tapered portion 35 of the tapered head portion of the polymer nose element 40A (versus being insert molded in place), at least a portion of the outer surface 41 of the smaller, forward tapered portion 35 and the interior wall 44 can be covered by the metal cap 20A, and at least a portion of the mating surfaces at 41 and 44 can be in contact with one another. After the two components are attached to one another, either mechanically or by way of insert molding, the surface profiles of the portions, 36 and 62, form and share a common ogive radius 46 which closely matches the ogive radius of the projectile. This arrangement results in a relatively smooth and continuous curvature (or surface profile) between components.

FIG. 5 is a longitudinal cross-sectional view of a projectile 100A including a nose insert 10 and a jacket 82 in accordance with an embodiment of the present disclosure. As can be seen, a projectile 100A includes a meplat 22A that can be used for both hunting and target shooting. It should be understood that the meplat 22A can comprise a flat or a spherical surface and can be of any size desired.

The projectile 100A is a generally cylindrical body, symmetrical in rotation about a central axis 15, with a rear end 78 and ends at the forward terminus 34 of the metal cap 20A. The projectile 100A, in some examples, can have an exterior surface shape that includes a rear portion 84 having a tapered frusto-conical "boat tail" surface. Adjacent to the rear surface can be a cylindrical intermediate portion 86 that continues forward from the rear portion 84 with a straight cylindrical side wall. Continuing, a forward ogive surface portion 88 has a gentle curve toward the meplat 22A of the metal cap 20A which includes the curvature of the jacket's ogive 74 (hereafter "jacket ogive"), the curvature of the rear tapered portion 62 of the tapered head portion 45 of the polymer nose element 40A, and the curvature of the tapered portion 36 of the metal cap 20A. If the meplat has a flat surface, such as meplat 22A shown in FIG. 5, the three curved portions of the projectile (the jacket ogive 74, the curvature of the rear tapered portion 62 of the tapered head portion 45 of the polymer nose element 40A and the curvature of the tapered portion 36 of the metal cap 20A) share a common radius and are all collectively part of the forward ogive surface portion 88.

Alternatively, if the meplat has a spherical surface, such as meplat 22B shown in FIG. 6, the meplat curvature can define a much smaller radius at its forward terminus 34 than any of the three larger curved portions which collectively define the forward ogive surface portion 88 of the projectile 100B. A spherical meplat configuration results in two radii (blended radii) in the tapered portion 36 of the metal cap 20B at its forward terminus 34 as shown generally in FIG. 6. It should be noted that the meplat 22B can include a radius of 0.010 of an inch or smaller if desired.

Regardless of the meplat geometry, the three larger curved portions of the projectile collectively result in a relatively smooth and continuous curvature between adjoining components and all contribute to forming the basic profile of the forward ogive surface portion 88 of the projectile. While a tangent ogive is shown in FIG. 5, the projectile 100A (as well as the projectile examples shown in FIGS. 6 and 7) can utilize either a tangent ogive or a secant ogive. A secant ogive has the potential to increase the BC of the projectile due to a sharper profile and may be preferable in some instances in which extremely long range shooting is concerned. It should also be understood that while a BC-enhancing boat tail is shown, a projectile utilizing the nose insert of the present disclosure can have a flat base without departing from the scope or spirit of the disclosure.

The projectile 100A, in an example embodiment, is formed of a copper or copper alloy jacket 82 having a base portion 80, with side walls 94 extending forward to a rim 96 at a forward position on the jacket ogive 74 of the jacket 82. The jacket 82 surrounds a core 92, such as a lead or lead alloy core, that defines a central cavity 99 in a forward face 98 of the core 92. The forward face 98 of the core 92 is rearward of the jacket edge or rim 96 in this particular embodiment, and the central cavity 99 is concentric with the central axis 15. The rim 96 of the jacket 82 tightly grips the larger shank diameter D1 of the first shank portion 60 at the wide shoulder 48 to centrally secure the nose insert 10 into the projectile 100A adjacent a portion of the jacket ogive 74. A central air space 76 can exist within the core 92. The central air space 76 can be of any size and shape and can exist between the rear 54 of the shank portion 50 of the polymer nose element 40A and the bottom 90 of the central cavity 99. The purpose of the central air space 76 is to help facilitate projectile expansion (or mushrooming) as the nose insert 10 is driven rearward into the core 92 upon impact with a target, for example a fluid-based target.

FIG. 6 is a partial longitudinal cross-sectional view of a projectile 100B that includes a nose insert 14 in accordance with another embodiment of the present disclosure. In this one example, the nose insert 14 includes a metal cap 20B and polymer nose element 40A. The polymer nose insert 40A has been previously described in relation to FIGS. 1 and 3. In addition, many of the features of the metal cap 20B have been previously described in relation to metal cap 20A shown in FIGS. 1 and 4. The nose insert 14 includes different sized components and shape compared to those shown in FIG. 5 and the meplat 22B of the metal cap 20B is spherical. Certain portions of the polymer nose element 40A may need to be resized and/or reshaped (when initially molded) to accommodate the size and shape of the metal cap 20B with its rounded meplat 22B in order to provide a smooth transition between components via a shared radius. Such resizing and/or reshaping may include altering the larger, rear tapered portion 62 of the tapered head portion 45 and the smaller, forward tapered portion 35 of the polymer nose element 40A. Generally speaking, the rounded tip configuration shown in this embodiment is similar to the rounded tip style of a conventional, all-polymer tip, except that the metal cap 20B depicted here is shown in a much larger size so that more detail in the tapered portion 36 of the metal cap 20B can be seen. It should be understood that the actual size of the radius defining the rounded meplat 22B of metal cap 20B can be 0.010 of an inch or smaller if desired.

FIG. 7 is a partial longitudinal cross-sectional view of the projectile 100C including a nose insert 16 in accordance with another embodiment of the present disclosure. In this one example, the nose insert 16 includes a metal cap 20C and polymer nose element 40A. The polymer nose insert 40A has been previously described in relation to FIGS. 1 and 3. In addition, many of the features of the metal cap 20C have been previously described in relation to metal cap 20A shown in FIGS. 1 and 4. The nose insert 16 includes a meplat 22C of the metal cap 20C that is flat but its width is much narrower than that of the meplat for previous embodiments described herein. The width of meplat 22C can be approximately 0.010 of an inch to maximize the BC of a projectile using the forward ogive surface portion 88. In other embodiments, the meplat 22C width can be as small as 0.001 inch. The sharply pointed tip configuration shown in this embodiment provides high velocity retention and a flat flight trajectory. Such a tip configuration can be useful as a long range target projectile or as a hunting projectile to harvest game animals at extreme ranges.

In addition, the metal cap 20C shown in FIG. 7 can include a small wall thickness, such that the metal cap 20C is economical to produce and easier to install around the forward tapered portion 35 of the polymer nose element 40A during the folding or crimping process when the nose insert components are mechanically assembled. As a result, the thinner wall of the metal cap 20C can also reduce the cost to manufacture the metal cap 20C. For example, twice as many metal caps can be produced from one pound of sheet metal having a thickness of 0.005 of an inch versus one pound of sheet metal having a thickness of 0.010 of an inch. As many as 12,000 metal caps can be produced from a single pound of low-cost aluminum sheet.

Figure 8:
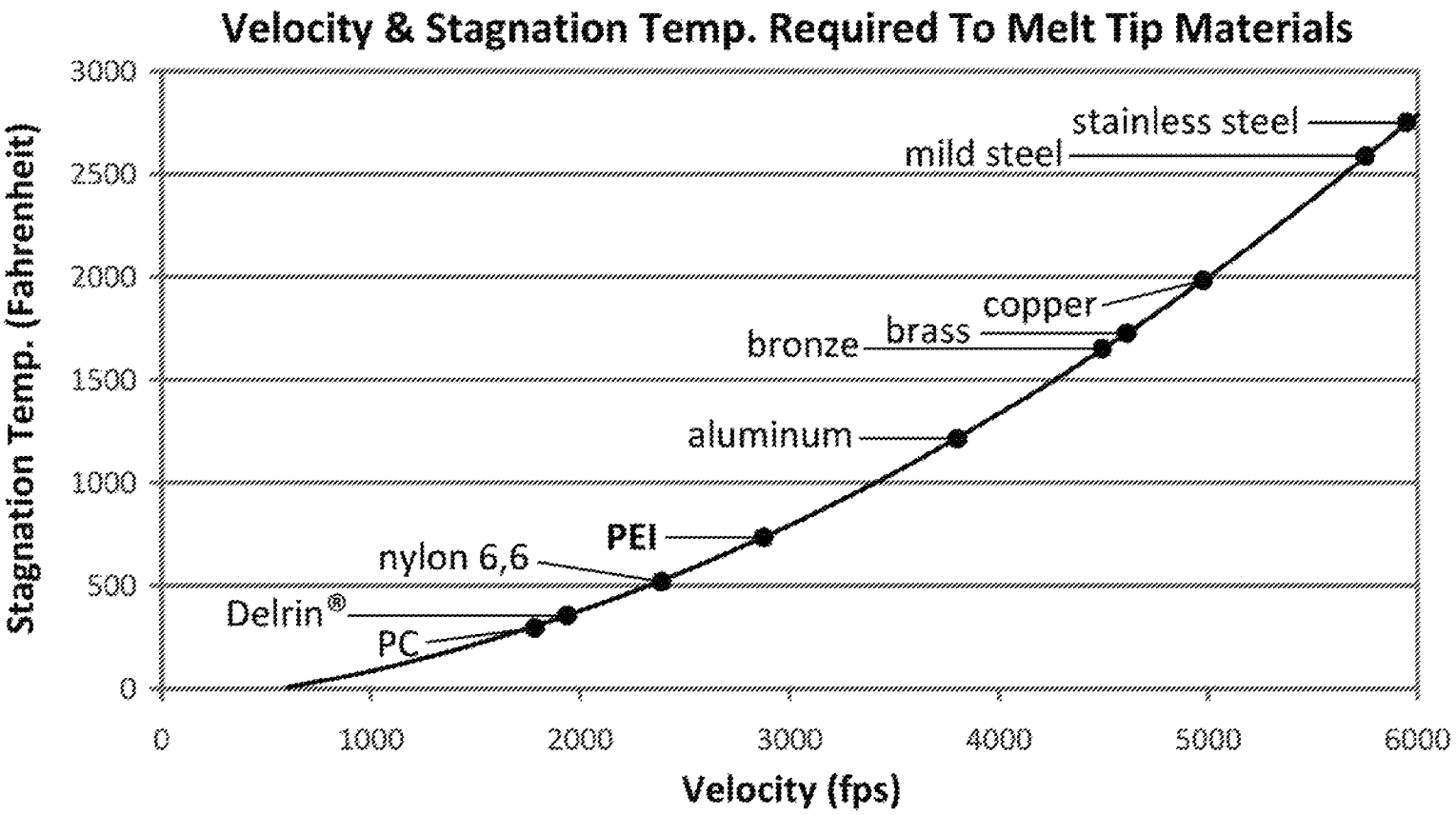
FIG. 8 is a graph illustrating stagnation temperatures relative to projectile velocity for various materials of a tip of the projectile, in accordance with an embodiment of the present disclosure.

FIG. 8 is a graph illustrating stagnation temperatures relative to projectile velocity for various materials used to form a tip of the projectile, in accordance with an embodiment of the present disclosure. The graph depicts the velocity required to achieve stagnation temperatures capable of melting or liquefying polymers currently used in all polymer projectile tips, as well as the velocity required to achieve stagnation temperatures capable of melting six metals that can be used to form the metal cap components of the present disclosure.

Table 3, provided below, shows the price per pound difference between both metals and polymers. The most salient comparisons with respect to the present disclosure are the low cost per pound of aluminum and DELRIN® versus the high cost of PEI.

TABLE 3

Price Comparison; Metals Versus Polymers

| METAL | Price Per pound |
|---|---|
| bronze | $2.91 |
| copper | $2.48 |
| brass | $2.08 |
| stainless steel | $.97 |
| aluminum | $.78 |
| mild steel | $.14 |
| **POLYMER** | **Price Per pound** |
| PEI | $8.80 |
| PC | $1.60 |
| nylon 6,6 | $1.41 |
| DELRIN ® | $1.39 |

The embodiments of the disclosure and the various features thereof are explained in detail with reference to the non-limiting embodiments and examples that are described and/or illustrated in the accompanying drawings. It should be noted that the features illustrated in the drawings are not necessarily drawn to scale, and features of one embodiment may be employed with other embodiments as the skilled artisan would recognize, even if not explicitly stated herein. Descriptions of certain components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure, which is defined solely by the appended claims and applicable law. Moreover, it is noted that like reference numerals represent similar parts throughout the several views of the drawings unless otherwise noted.

It is understood that the disclosure is not limited to the particular methodology, devices, apparatus, materials, applications, etc., described herein, as these may vary. It is also to be understood that the terminology used herein is used for the purpose of describing particular embodiments only, and is not intended to limit the scope of the disclosure. It must be noted that as used herein and in the appended claims, the singular forms "a," "an," and "the" include plural reference unless the context clearly dictates otherwise.

Unless defined otherwise, all technical and scientific terms used herein have the same meanings as commonly understood by one of ordinary skill in the art to which this disclosure belongs. Methods, devices, and materials are described, although any methods and materials similar or equivalent to those described herein can be used in the practice or testing of the disclosure.

Still further, the corresponding structures, materials, acts, and equivalents of all means plus function elements in any claims below are intended to include any structure, material, or acts for performing the function in combination with other claim elements as specifically claimed.

Those skilled in the art will appreciate that many modifications to the embodiments are possible without departing from the scope of the disclosure. In addition, it is possible to use some of the features of the embodiments described without the corresponding use of the other features. Accordingly, the foregoing description of the exemplary embodiments is provided for the purpose of illustrating the principle of the disclosure, and not in limitation thereof, since the scope of the disclosure is defined solely be the appended claims.

What is claimed is:

1. A nose insert for use in a projectile comprising:

a polymer nose element including a tapered head portion attached to a shank portion, the tapered head portion including a forward tapered portion and a rear tapered portion, the rear tapered portion being between the forward tapered portion and the shank portion, and the shank portion including a diameter smaller than a diameter of the rear tapered portion adjacent to the shank portion; and a metal cap disposed on the forward tapered portion of the tapered head portion of the polymer nose element, the metal cap terminates at a forward end in a meplat.

2. The nose insert of claim 1, wherein the metal cap prevents deformation of the polymer nose element during flight of the projectile at temperatures of between 1,200 degrees F. and 2,700 degrees F.

3. The nose insert of claim 1, wherein the metal cap includes a wall thickness ranging from 0.005 of an inch to 0.020 of an inch.

4. The nose insert of claim 1, wherein the metal cap includes a wall thickness that varies along a length of the metal cap so that a forward portion of the metal cap has increased wall thickness compared to a rear portion of the metal cap.

5. The nose insert of claim 1, wherein a first curved portion of the tapered head portion of the polymer nose element is in contact with an inner surface of the metal cap when the metal cap is disposed on the polymer nose element.

6. The nose insert of claim 1, wherein the metal cap includes a locking ridge, the locking ridge is disposed on an inner surface of the metal cap and interfaces with an outer surface of the tapered head portion of the polymer nose element.

7. The nose insert of claim 6, wherein the locking ridge is disposed along a circumference of an interior wall of the metal cap and extends from the interior wall inwardly towards a central axis of the nose insert.

8. The nose insert of claim 1, wherein the meplat of the metal cap is flat and has a diameter between 0.001 and 0.100 of an inch.

9. The nose insert of claim 1, wherein the meplat of the metal cap defines a radius having a width between 0.001 and 0.100 of an inch.

10. The nose insert of claim 1, wherein the tapered head portion of the polymer nose element and an outer surface of the metal cap have a common ogive radius.

11. The nose insert of claim 1, wherein the tapered head portion of the polymer nose element includes a first curved portion, a second curved portion, and a shoulder, the first curved portion extending from a forward end of the tapered head portion to the second curved portion, and the shoulder defines a sloping angle between the first curved portion and the second curved portion.

12. The nose insert of claim 11, wherein the sloping angle between the first curved portion and the second curved portion is less than 90 degrees from a central axis of the nose insert.

13. The nose insert of claim 11, wherein an outer surface of the first curved portion of the tapered head portion of the polymer nose element is recessed below an outer surface of the second curved portion of the tapered head portion of the polymer nose element, such that an outer surface of the metal cap and the second curved portion have a common ogive radius.

14. The nose insert of claim 11, wherein the second curved portion of the tapered head portion of the polymer nose element and a tapered outer curvature of the metal cap include a common radius.

15. A projectile comprising:

a unitary body, including a forward end opposite a rear end and an intermediate cylindrical portion positioned between the rear end and the forward end, the unitary body further including a cavity within the forward end;

a nose insert disposed in the unitary body, the nose insert comprising a polymer nose element received within the cavity of the unitary body and including a tapered head portion attached to a shank portion, the tapered head portion including a forward tapered portion and a rear tapered portion, the rear tapered portion being between the forward tapered portion and the shank portion, and the shank portion including a diameter smaller than a diameter of the rear tapered portion adjacent to the shank portion; and a metal cap disposed on the forward tapered portion of the tapered head portion of the polymer nose element, the metal cap terminates at a forward end in a meplat.

16. The projectile of claim 15, further comprising an ogive radius for each of an outer surface profile of the tapered head portion of the polymer nose element and an outer surface profile of a jacket of the projectile, wherein the ogive radius is the same for each of the outer surface profile of the tapered head portion of the polymer nose element and the outer surface profile of a jacket of the projectile.

17. The projectile of claim 15, further comprising an ogive radius for each of an outer surface profile of the tapered head portion of the polymer nose element and an outer surface profile of an outer curved portion of the metal cap, wherein the ogive radius is the same for each of the outer surface profile of the tapered head portion of the polymer nose element and the outer surface profile of the outer curved portion of the metal cap.

18. The projectile of claim 15, further comprising an ogive radius for each of an outer surface profile of the tapered head portion of the polymer nose element, an outer surface profile of an outer curved portion of the metal cap, and an outer surface profile of a jacket of the projectile, wherein the ogive radius is the same for each of the outer surface profile of the tapered head portion of the polymer nose element, the outer surface profile of the outer curved portion of the metal cap, and the outer surface profile of a jacket of the projectile.

19. The projectile of claim 15, wherein the nose insert is disposed within the unitary body, such that a rear surface of the shank portion of the polymer nose element is not in contact with a bottom surface of the cavity of the unitary body.

20. The projectile of claim 19, wherein in response to impact of the projectile with a target, the nose insert is configured to move rearward within the cavity of the unitary body to expand the projectile.

* * * * *